US008216027B2

(12) United States Patent
Zahner, III

(10) Patent No.: US 8,216,027 B2
(45) Date of Patent: Jul. 10, 2012

(54) APPARATUS FOR APPLYING A FINISH TO A METAL SURFACE AND METHOD OF APPARATUS CONSTRUCTION

(75) Inventor: L. William Zahner, III, Kansas City, MO (US)

(73) Assignee: A. Zahner Company, Kansas City, MO (US)

( * ) Notice: Subject to any disclaimer, the term of this patent is extended or adjusted under 35 U.S.C. 154(b) by 672 days.

(21) Appl. No.: 12/402,822

(22) Filed: Mar. 12, 2009

(65) Prior Publication Data

US 2010/0233942 A1 Sep. 16, 2010

(51) Int. Cl.
*B24B 7/00* (2006.01)

(52) U.S. Cl. ..... 451/278; 451/280; 451/294; 451/342

(58) Field of Classification Search ..... 451/278, 451/280, 294, 270, 262, 342, 159, 174; 29/428; 310/51, 91, 12.14, 15
See application file for complete search history.

(56) References Cited

U.S. PATENT DOCUMENTS

| | | | | | |
|---|---|---|---|---|---|
| 1,352,519 | A * | 9/1920 | Laserson | 30/377 |
| 1,794,149 | A * | 2/1931 | Collins | 408/135 |
| 1,872,426 | A * | 8/1932 | Drake et al. | 451/260 |
| 1,945,496 | A * | 1/1934 | Sloan et al. | 318/475 |
| 2,006,630 | A * | 7/1935 | Dutro et al. | 451/430 |
| 2,069,694 | A * | 2/1937 | Brinkert | 248/638 |
| 2,113,276 | A * | 4/1938 | Moore | 451/429 |
| 2,113,475 | A * | 4/1938 | Faber | 15/49.1 |
| 2,398,556 | A * | 4/1946 | Pearson | 451/159 |
| 2,417,737 | A * | 3/1947 | Culp | 451/262 |
| 2,709,873 | A * | 6/1955 | Lewis | 451/163 |
| 3,358,406 | A * | 12/1967 | Speno, Jr. et al. | 451/347 |
| 4,991,360 | A * | 2/1991 | DeSpain | 451/36 |
| 5,048,141 | A * | 9/1991 | Huppi | 15/49.1 |
| 5,090,657 | A * | 2/1992 | Dreiman | 248/624 |
| 5,496,206 | A * | 3/1996 | Young | 451/260 |
| 5,521,447 | A * | 5/1996 | Bertolini et al. | 310/51 |
| 5,888,123 | A * | 3/1999 | Wang | 451/65 |
| 6,107,705 | A * | 8/2000 | Durantay et al. | 310/51 |
| 6,808,439 | B2 * | 10/2004 | Carpenter | 451/34 |
| 7,488,241 | B2 * | 2/2009 | Elek et al. | 451/293 |
| 2003/0164653 | A1 * | 9/2003 | Yasuda | 310/90 |
| 2006/0070922 | A1 * | 4/2006 | LaVeine | 209/223.1 |
| 2007/0101845 | A1 * | 5/2007 | Bettacchini | 83/397 |

* cited by examiner

*Primary Examiner* — George Nguyen
(74) *Attorney, Agent, or Firm* — Hovey Williams LLP

(57) ABSTRACT

An apparatus for applying a lightly scratched surface to a metal sample comprises a motor, a disk, a frame, a motion guidance unit, and a plurality of springs. The motor may provide a rotational motion to the disk which includes abrasive elements configured to create a plurality of microscopic scratches on the surface of the metal sample. The frame may include a bottom wall with an opening in which the motor is positioned. The motion guidance unit may retain the frame and guide the motion of the motor across the surface of the metal sample. The plurality of springs may couple the motor to the bottom wall of the frame in order to suspend the motor within the opening of the bottom wall and to allow lateral motion of the motor and the disk while the motor is rotating.

21 Claims, 7 Drawing Sheets

APPARATUS FOR APPLYING A FINISH TO A METAL SURFACE AND METHOD OF APPARATUS CONSTRUCTION

BACKGROUND OF THE INVENTION

1. Field of the Invention

Embodiments of the present invention relate to the processing of metallic surfaces. More particularly, embodiments of the present invention relate to an apparatus to apply a lightly scratched finish to a metal surface and a method of construction of the apparatus.

2. Description of the Related Art

Exposed metal is often used as a wall surface, particularly on the exteriors of buildings, such as event centers, coliseums, or museums. It is usually desirable that the surface have a finish that scatters light to avoid harsh glares or strong reflection of the sun. Generally, a lightly scratched metal surface has a soft or matted appearance that is more aesthetically pleasing.

Prior art techniques to produce a lightly-scratched metallic surface have involved manual approaches as well as machine-controlled processes. With manual approaches, an operator may use a handheld sanding disc or a floor sander to apply scratches to the surface of the metal and must visually judge the level of scratching on the surface. Typically, some areas are more scratched than others, resulting in a surface that looks non-uniform.

Machine-controlled techniques may involve adapting a rotating sanding disc to a computer numerical controlled (CNC) machine. The sanding disc may be scanned across the metallic surface to apply scratches in a more uniform manner than manual approaches. However, the surface may include subtle lines where the scanning pattern overlaps that have a darker shading than other areas of the surface. Furthermore, the overlapped areas may appear to have large arc-shaped features under certain lighting. As a result, the machine-controlled approach may be less aesthetically pleasing due to subtle imperfections.

SUMMARY OF THE INVENTION

Embodiments of the present invention solve the above-mentioned problems and provide a distinct advance in the art of processing of metallic surfaces. More particularly, embodiments of the invention provide an improved apparatus for applying a lightly scratched finish to a metal surface and a method of constructing the apparatus.

Various embodiments of the invention include an apparatus which comprises a frame, a motor, a disk, a motion guidance unit, a plurality of upper springs, and a plurality of lower springs. The motor generally provides rotation for the disk, which may be coupled to the motor and may include abrasive elements that create a plurality of microscopic scratches on the surface of the metal sample.

The frame may include a bottom wall that has an opening in which the motor is positioned. The frame may be retained by the motion guidance unit which may control the motion of the motor and in turn the disk across the surface of the metal sample.

The upper springs may couple the motor to the upper surface of the bottom wall. The lower springs may couple the motor to the lower surface of the bottom wall and in combination with the upper springs, may suspend the motor within the opening. The upper and lower springs may also allow lateral motion of the motor and the disk while the motor is rotating. The lateral motion of the motor and the disk may allow the plurality of the microscopic scratches on the surface of the metal sample to have a curvature and to overlap one another, thereby scattering the reflected light from the surface and giving the metal a matted or softened appearance.

Other embodiments of the invention include a method of constructing the apparatus that applies a lightly scratched finish to a metal surface. The method may comprise the steps of forming an opening in a bottom wall of a frame, and positioning within the opening a motor that includes a disk with abrasive elements. The method may also include coupling the frame to a motion guidance unit that controls the motion of the motor across the surface. The method may further include coupling a plurality of upper springs from the motor to the upper surface of the bottom wall and coupling a plurality of lower springs from the motor to the lower surface of the bottom wall. The upper springs in combination with the lower springs may suspend the motor within the opening and allow lateral motion of the motor and the disk while the motor is rotating.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Embodiments of the present invention is described in detail below with reference to the attached drawing figures, wherein.

Figure 1:
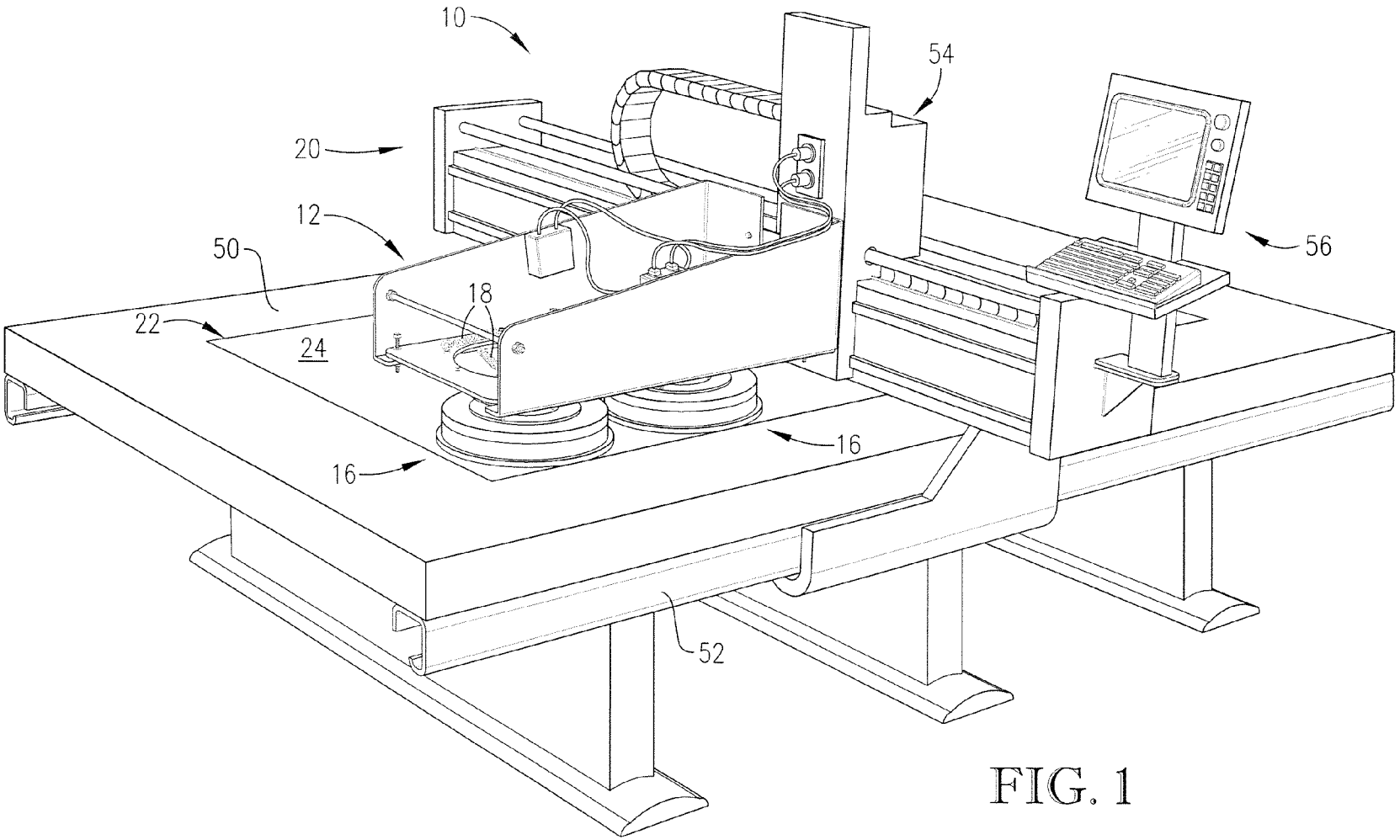
FIG. 1 is a perspective view of an apparatus for applying a lightly scratched finish to a metal surface, as constructed in accordance with various embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

An apparatus 10 for applying a lightly scratched finish to a metal surface, constructed in accordance with various embodiments of the current invention, is shown in FIG. 1. The apparatus 10 broadly comprises a frame 12, a finish motor 14, a finish application disk 16, a plurality of springs 18, and a motion guidance unit 20. The apparatus 10 generally applies a finish to a metal sample 22 that includes a surface 24. Typically, the metal sample 22 is a sheet or a plate of metal, although other shapes or configurations are possible. The apparatus 10 may be used to create a lightly scratched surface on various types of metal, including aluminum, copper, and stainless steel, among others.

Figure 5:
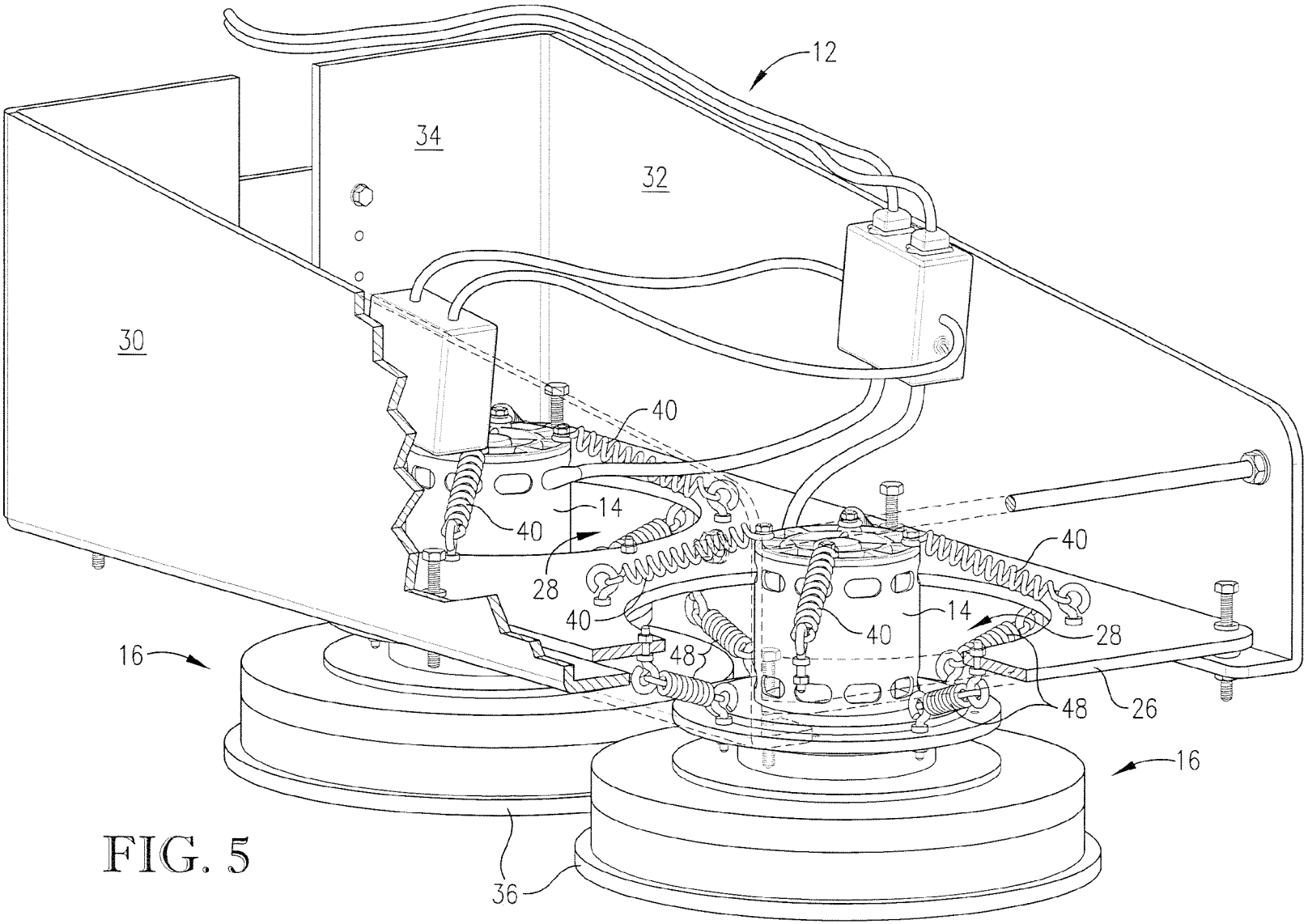
FIG. 5 is a perspective view from above the second portion of the apparatus, with a portion of the frame cut away.
Figure 6:
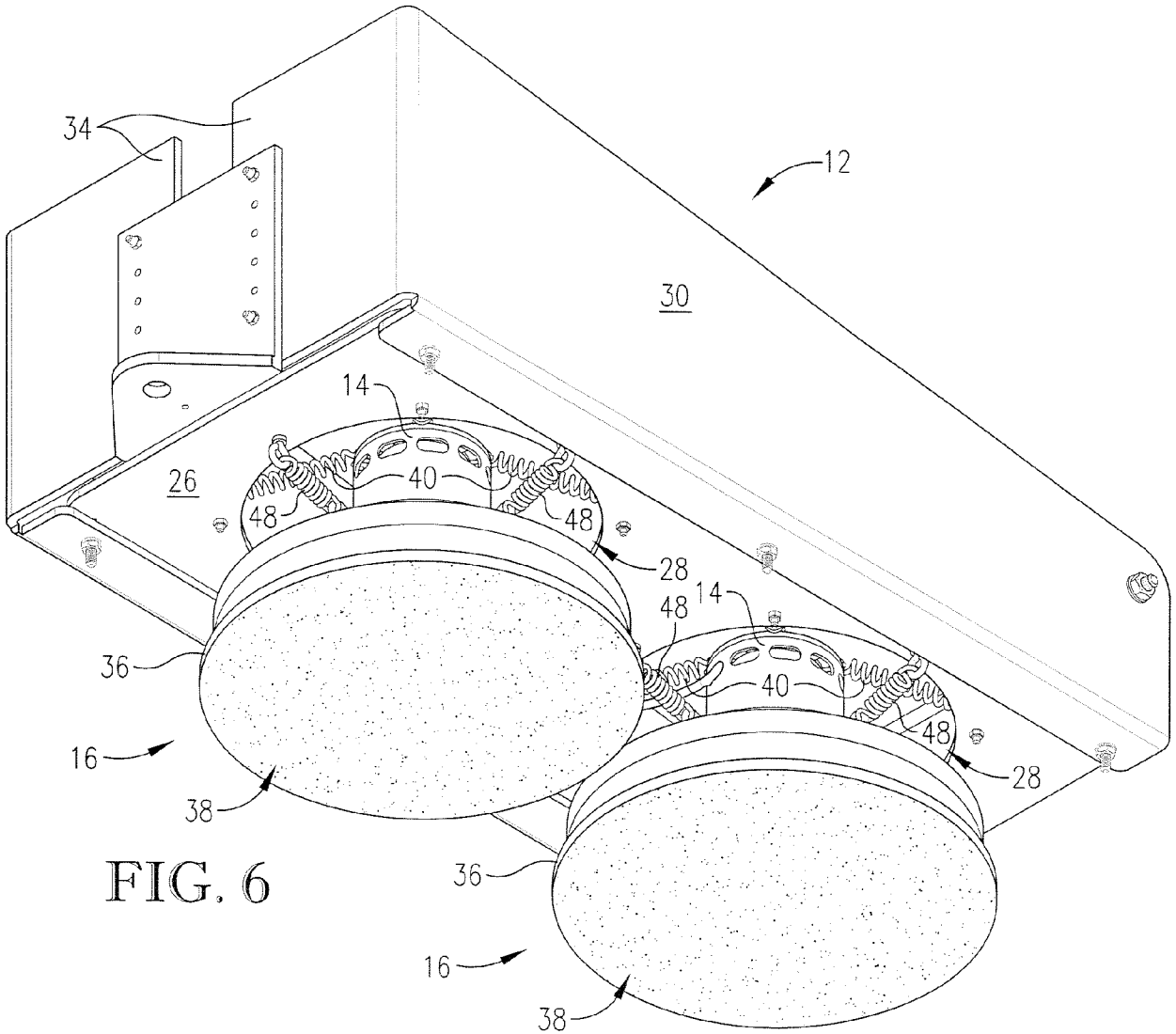
FIG. 6 is a perspective view from below the second portion of the apparatus showing a plurality of finish application disks.

The frame 12 generally retains the finish motor 14 and the springs 18. The frame 12 may be coupled with the motion guidance unit 20. In various embodiments, the frame 12 may be integrated with or considered part of the motion guidance unit 20. The frame 12 may include a bottom wall 26 with one or more openings 28, as best seen in FIGS. 5-6. At least a portion of the finish motor 14 may occupy the space of the opening 28, and the springs may be connected to the bottom wall 26 of the frame 12 in the vicinity of the opening 28. The frame 12 may also include a left side wall 30, a right side wall 32, and a rear wall 34, as best seen in FIG. 5. Attached to the left side wall 30 and the right side wall 32 may be electrical power interface components for the finish motor 14. In addition, mechanical stability components may be coupled to the left side wall 30 and the right side wall 32. In various embodiments, the bottom wall 26 may be mechanically isolated from the left side wall 30, the right side wall 32, and the rear wall 34.

The frame 12 may be manufactured from a metal, such as steel. The frame 12 may be wide enough to accommodate the finish motor 14. The diameter of the opening 28 of the bottom wall 26 may be at least as wide as the diameter of the finish motor 14, and may be wider than the diameter of the finish motor 14.

The finish motor 14 generally rotates the finish application disk 16 while the disk 16 is guided across the surface 24 of the metal sample 22. The finish motor 14 may not be rigidly secured to the frame 12, but instead may be coupled to the frame 12 through the springs 18 only, as described in more detail below. The finish motor 14 may have a generally cylindrical shape.

The finish motor 14 may include many types of motors or mechanisms that convert electric current to rotational mechanical motion, such as alternating current (AC) induction motors, AC synchronous motors, brushless direct current (DC) motors, brushed DC motors, universal motors, and the like.

Figure 3:
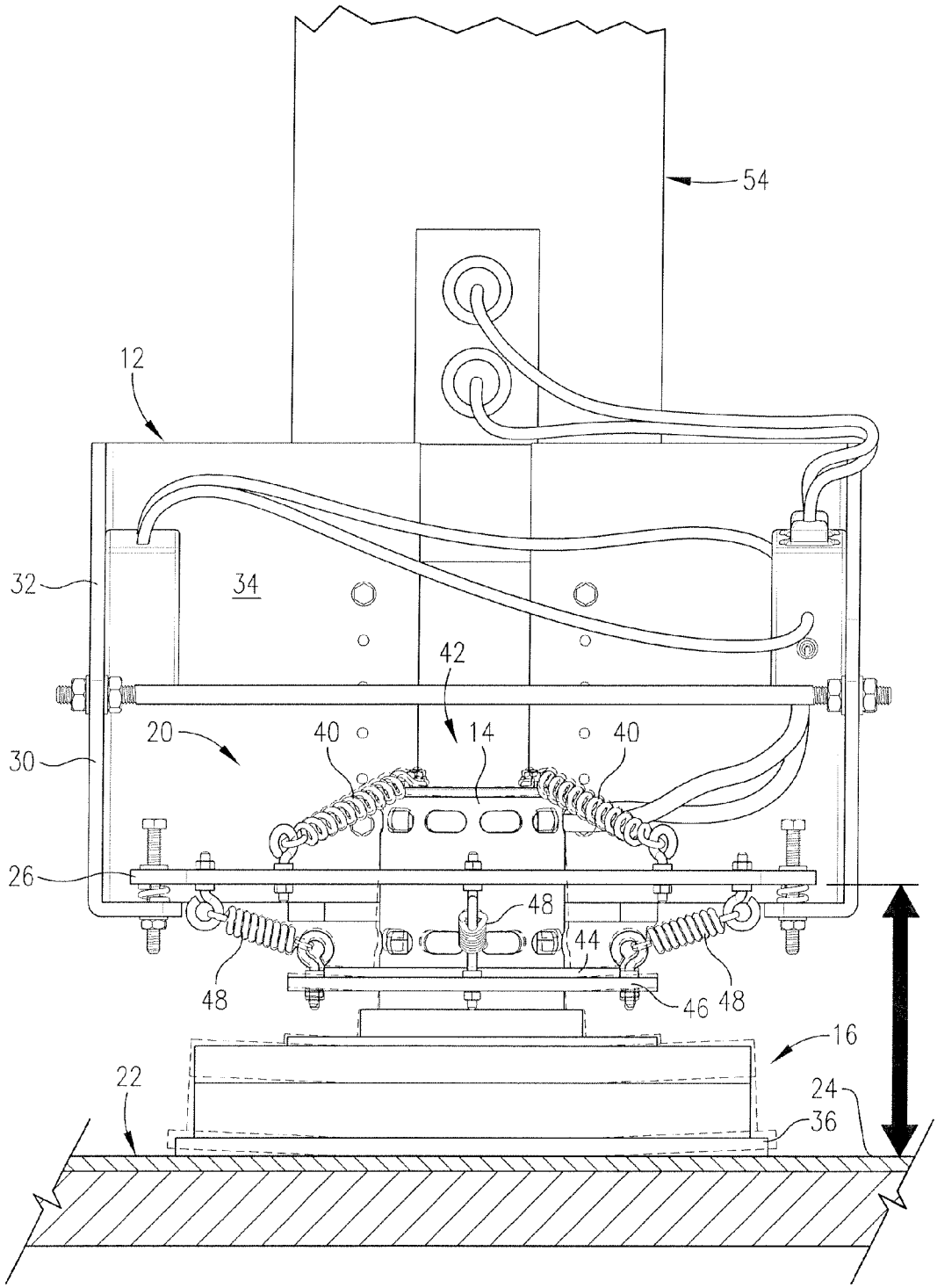
FIG. 3 is a front view of a second portion of the apparatus, showing slight oscillation of several components of the apparatus.
Figure 4:
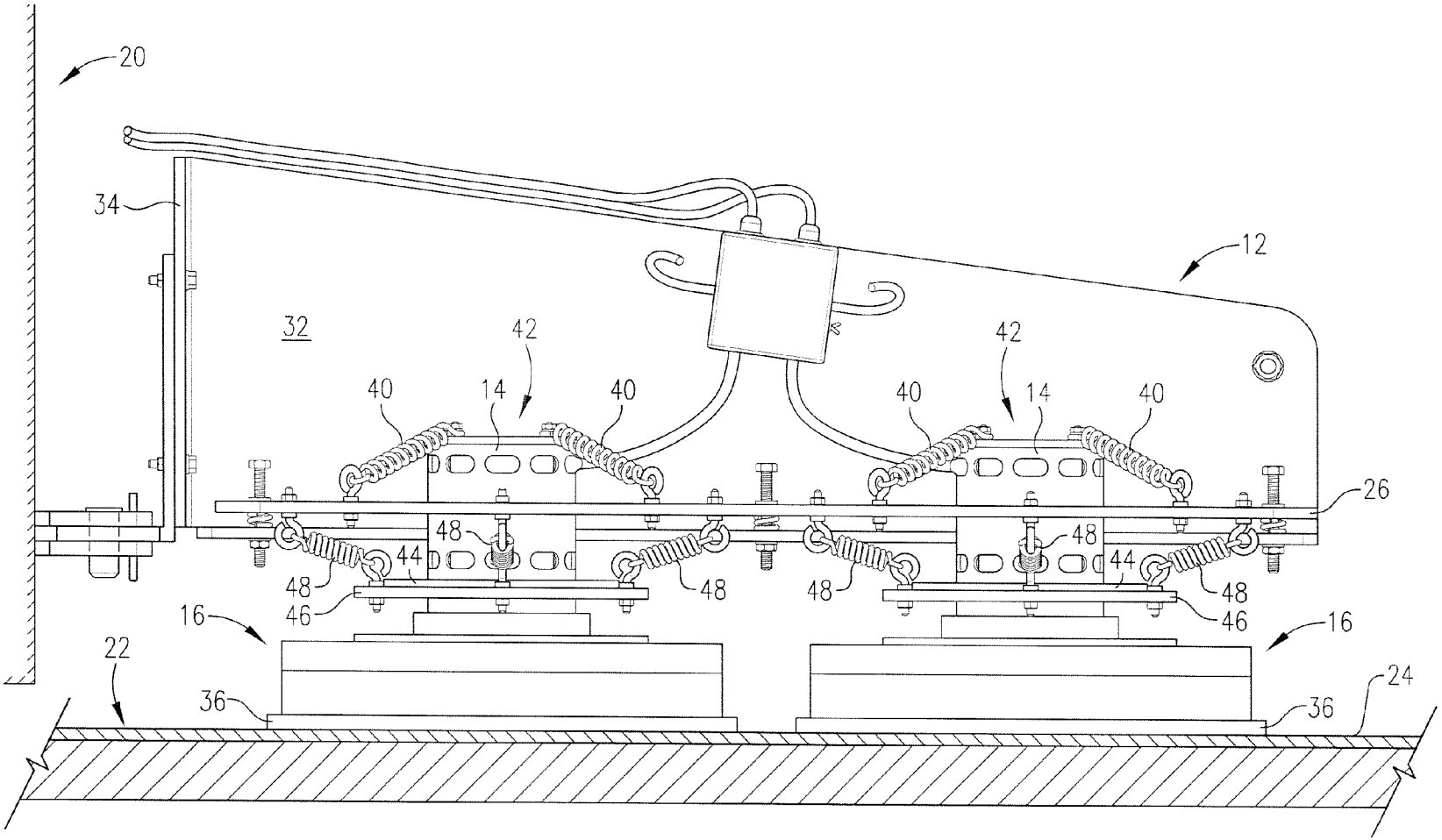
FIG. 4 is a side view of the second portion of the apparatus, with a portion of a frame removed.

As seen in FIGS. 3 and 4, the finish application disk 16 generally contacts the surface 24 of the metal sample 22 in a rotating fashion in order to create the lightly scratched finish on the surface 24. While being rotated by the finish motor 14, the finish application disk 16 is guided over the surface 24 by the motion guidance unit 20. The finish application disk 16 is coupled to the output shaft of the finish motor 14. The finish application disk 16 is generally circular in shape and may be sized based on the capabilities of the finish motor 14 or other performance criteria. The finish application disk 16 may include a contact layer 36 with a plurality of abrasive elements 38, such as fibers, bristles, or abrading grit of microscopic size, that comes into contact with the surface 24 of the metal sample 22, as seen in FIG. 6. The size of the abrasive elements 38 on the contact layer 36 may be exaggerated in FIG. 6 for illustrative purposes. These abrasive elements 38 on the contact layer 36 may scratch the surface 24 when they are moved or dragged against the surface 24, thereby creating a microscopic ridge and valley along the path of the scratch. The finish application disk 16 may also include one or more layers of padding or cushioning between the contact layer 36 and the point of coupling with the finish motor 14.

The springs 18 generally couple to the finish motor 14 to the frame 12 in order to allow the finish motor 14 to wobble in a controlled fashion while the finish application disk 16 is rotating. The springs 18 may be manufactured from a metal, such as steel, and may be relatively stiff. The stiffness of the springs 18 may be determined by the weight of the finish motor 14, the relative dimensions of the diameter of the finish motor 14, the lengths of the springs 18, and the diameter of the opening 28 of the bottom wall 26 of the frame 12, and the pattern of the scratches that the finish application disk 16 makes.

In various embodiments, the apparatus 10 includes eight springs 18, as seen in FIGS. 3-5. In other embodiments, there may be a greater number or a lesser number of springs 18 depending on design requirements or constraints. There may be four upper springs 40 that couple from the upper surface of the bottom wall 26 of the frame 12 to a distal end 42 (away from the output shaft) of the finish motor 14. The four upper springs 40 may be positioned radially outward from the finish motor 14 and evenly spaced around the circumference of the finish motor 14 with a separation of approximately 90°.

The finish motor 14 may include a coupling ring 44 attached to the circumference of the body of the finish motor 14 at a certain distance away from the distal end 42 of the finish motor 14. The coupling ring 44 may include a flange 46 that extends radially outward from the finish motor 14. There may be four lower springs 48 that couple from the lower surface of the bottom wall 26 to the flange 46. In various embodiments, the four lower springs 48 may couple from the lower surface of the bottom wall 26 directly to the finish motor 14. The four lower springs 48 may be positioned radially outward from the finish motor 14 and evenly spaced around the circumference of the finish motor 14 with a separation of approximately 90°. The location of the four lower springs 48 may be offset relative to the location of the four upper springs 40 by an angle of approximately 45°.

Once the apparatus 10 is assembled, the finish motor 14 may be positioned roughly in the center of the opening of the bottom wall 26 of the frame 12, with a portion of the distal end 42 of the finish motor 14 being positioned above the plane of the bottom wall 26. The springs 18 may suspend the finish motor 14 within the opening 28 of the frame 12, such that the plane of the bottom wall 26 aligns with a point roughly midway between where the lower springs 48 couple with the finish motor 14 and where the upper springs 40 couple with the finish motor 14.

Figure 2:
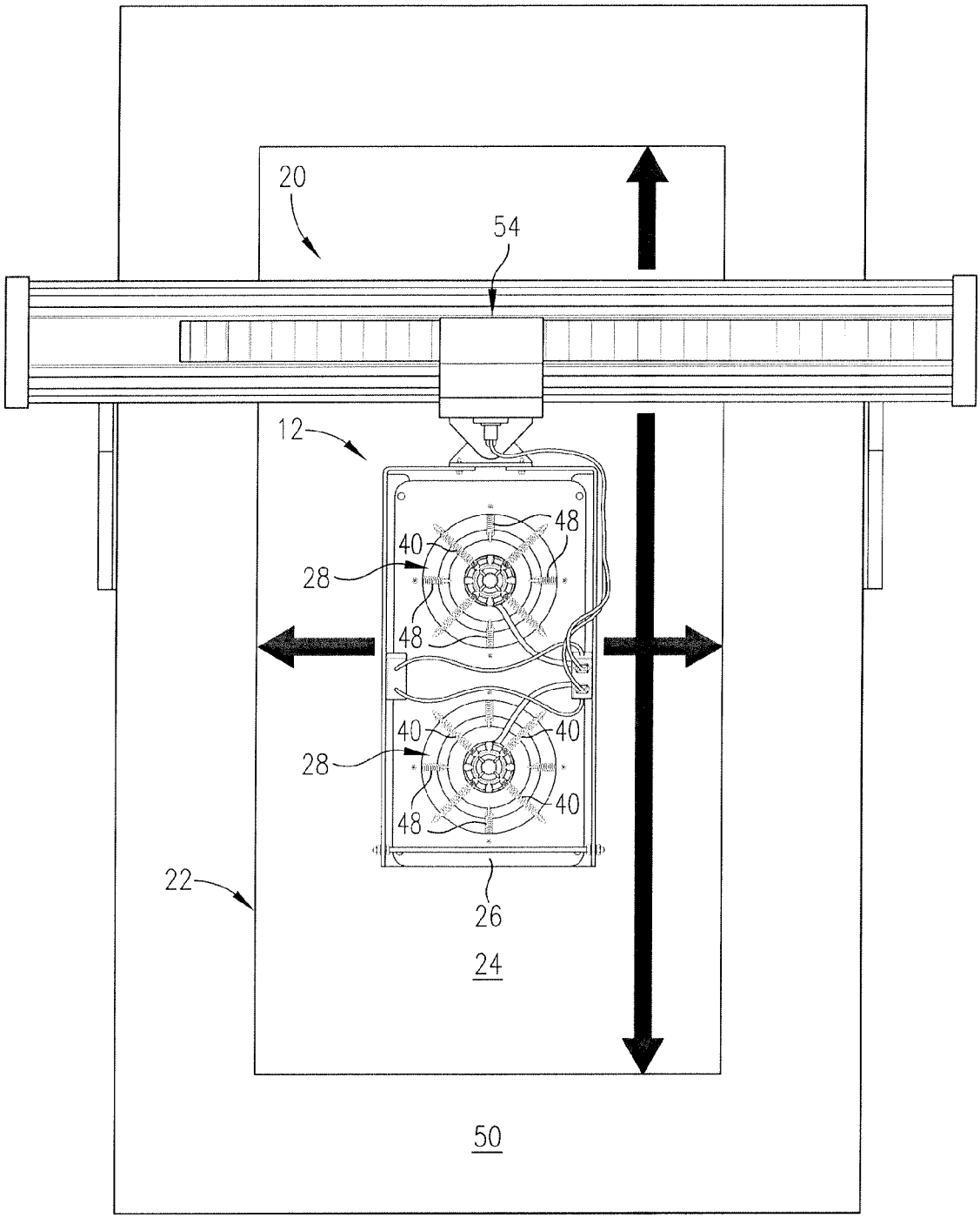
FIG. 2 is a top view of a first portion of the apparatus.

The motion guidance unit 20 generally guides the frame 12, the finish motor 14, the springs 18, and the finish application disk 16 across the surface 24 of the metal sample 22 while the metal sample 22 remains relatively stationary. In various other embodiments, in addition to or as opposed to guiding the frame 12, the finish motor 14, the springs 18, and the finish application disk 16, the motion guidance unit 20 may also guide the motion of the metal sample 22 while the apparatus 10 remains substantially stationary and applies a finish to the metal surface 24. The motion guidance unit 20 may provide motion in two directions within a plane, indicated in bold lines in FIG. 2. For example, the motion guidance unit 20 may provide motion along an x-axis and a y-axis, as conventionally recognized. In other embodiments, the motion guidance unit 20 may also provide motion on multiple planes, or along a z-axis, indicated in a bold line in FIG. 3.

The apparatus 10 may also include a table 50 with clamping, supporting, or other fixturing to hold the metal sample 22 in place while the finishing process is taking place. The motion guidance unit 20 may include a track 52 or runner for each axis of motion (e.g., x, y, and z) to allow movement along that axis, as seen in FIG. 1. In addition, the motion guidance unit 20 may include one or more drive sources 54 or actuating sources for each axis of motion that drive the relative movement along that axis. Furthermore, the motion guidance unit 20 may include a controller 56 to control the operation of the drive source 54, in turn controlling the relative motion of the metal sample 22. The controller 56 may be programmed with the dimensions and shape of the metal sample 22 to automatically determine a pattern to follow for applying the lightly scratched finish to the surface 24. Or the controller 56 may be programmed with the pattern to follow for processing the surface. The controller 56 may receive information or instructions as a batch of program code segments or as a series of keystrokes entered directly to the motion guidance unit 20 one at a time.

The controller 56 may include data storage elements such as hard disk drives, optical disk drives, floppy disk drives, flash memory drives, etc., data entry elements such as keyboards, keypads, mice, joysticks, etc., data output elements such as monitors, displays, indicator lights, printers, etc., and data communication elements such as network interface ports—both wired and wireless. The controller 56 may further include data processing elements such as microprocessors, microcontrollers, programmable logic devices (PLDs), field-programmable gate arrays (FPGAs), application-specific integrated circuits (ASICs), in addition to interface or conversion circuitry to properly couple with the drive source 54.

In various embodiments, the motion guidance unit 20 may also include a computer numeric-controlled (CNC) machine, as is commonly known.

Various embodiments of the apparatus 10 may include additional components to improve efficiency, increase throughput, or reduce processing time of a system utilizing the apparatus 10 to produce sheets of metal with a lightly scratched finish. These embodiments of the apparatus 10 may include a plurality of finish motors 14 each with a single finish application disk 16 and each motor 14 coupled through a set of springs 18 to a single frame 12. The motion of the frame 12 may be controlled by a single motion guidance unit 20. In other embodiments, the apparatus 10 may include a plurality of motion guidance units 20, each including a frame 12 with one or more finish motors 14, finish application disks 16, and sets of springs 18. The motion guidance units 20 may share a controller 56 or may have individual controllers 56 that communicate with each other.

The apparatus 10 may operate as follows. A metal sample 22 is secured to the table 50 to prepare for processing. The size and shape of the sample 22, a scanning pattern, or other instructions may be programmed into the motion guidance unit 20. The frame 12 may be lowered such that the contact layer 36 of the finish application disk 16 touches the surface 24 of the metal sample 22. Electric power may be applied to the finish motor 14 to rotate the finish application disk 16.

The rotation of the finish application disk 16 may cause a lateral oscillation, or wobble, of the finish motor 14, such that the center of rotation of the finish application disk 16 may move or oscillate. The lateral oscillation may be accompanied by a slight vertical motion or wobble as well, as seen in FIG. 3. When the contact layer 36 of the finish application disk 16 is rubbed or dragged across the surface 24 of the metal sample 22, a series of microscopic scratches, or ridges and valleys, may be created on the surface 24. The lateral oscillation of the finish motor 14 may cause the ridges and valleys to be shaped in eccentric arcs, such that the ridges and valleys are curved and overlap one another. The overlapping arcs on the surface 24 generally cause the light that is reflected from the surface 24 to undergo the phenomenon of scattering, which leads to a matted or softened appearance of the metal sample 22.

The motion guidance unit 20 maintains a downward force on the finish motor 14 and in turn the finish application disk 16 while the finish motor 14 is being guided in the x-axis and y-axis directions to scan the surface 24 of the metal sample 22. The motion guidance unit 20 continues to guide the finish application disk 16 across the surface 24 until the desired portion of the surface 24 has been processed. The sample 22 may then be removed from the apparatus 10.

Figure 7:
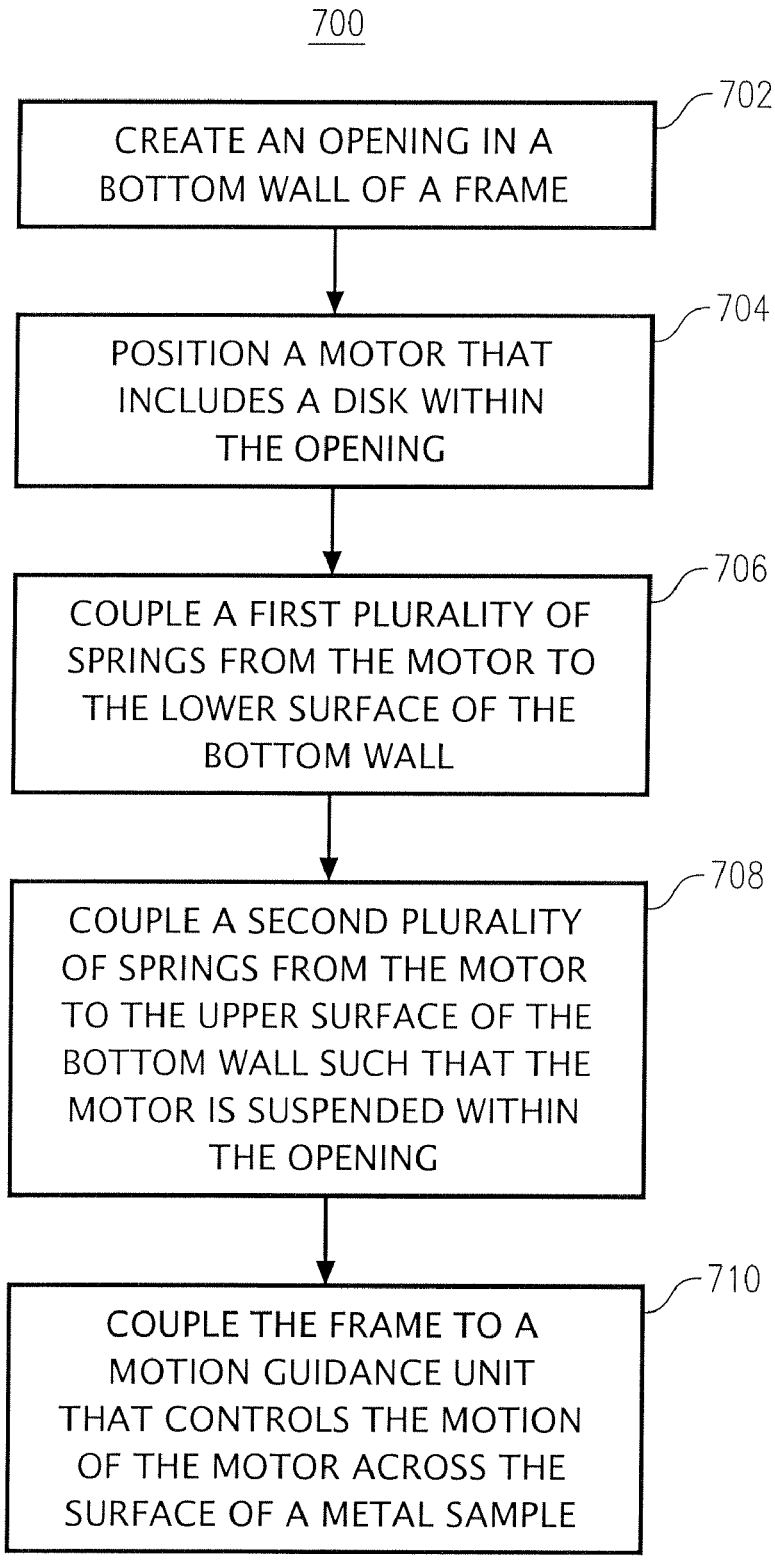
FIG. 7 is a flow diagram showing at least a portion of the steps of a method for constructing the apparatus.

At least a portion of the steps of a method 700 of constructing an apparatus for applying a lightly scratched finish to a surface 24 of a metal sample 22 in accordance with various embodiments of the present invention is shown in FIG. 7. Some steps may be performed concurrently instead of sequentially, as shown. Additionally, some steps may be performed in reverse order from what is shown in FIG. 7.

In connection with step 702, an opening 28 is created in a bottom wall 26 of a frame 12. The opening 28 is generally circular. The frame 12 may include other structures, such as side walls, a rear wall, etc.

In connection with step 704, a finish motor 14 is positioned within the opening 28. The finish motor 14 may include a rotating output shaft to which a finish application disk 16 may be coupled. The finish application disk 16 may include a contact layer 36 which may be constructed from abrasive elements 38 that create microscopic ridges and valleys on the surface 24 of the metal sample 22 when the finish application disk 16 is rubbed or dragged across the surface 24. The finish motor 14 may be positioned within the opening 28 such that a distal end 42 of the finish motor 14 is above the bottom wall 26 of the frame 12 and the finish application disk 16 is below the bottom wall 26.

In connection with step 706, a plurality of upper springs 40 is coupled from the upper surface of the bottom wall 26 to the distal end 42 of the finish motor 14. In various embodiments, there may be four upper springs 40 that are evenly spaced around the circumference of the finish motor 14 and are separated by an angle of approximately 90°.

In connection with step 708, a plurality of lower springs 48 is coupled from the lower surface of the bottom wall 26 to a flange 46 of a coupling ring 44 that is attached to the finish motor 14. In other embodiments, the four lower springs 48 may couple from the lower surface of the bottom wall 26 directly to the finish motor 14. In various embodiments, there may be four lower springs 48 that are evenly spaced around the circumference of the finish motor 14 and are separated by an angle of approximately 90°. The orientation of the four upper springs 40 may be offset from the orientation of the four lower springs 48 by an angle of approximately 45°.

In connection with step 710, the frame 12 is coupled to a motion guidance unit 20 that controls the motion of the finish motor 14 across the surface 24 of the metal sample 22. The motion guidance unit 20 may control the motion of the finish motor 14 in a plane in the x-axis and y-axis directions. The motion guidance unit 20 may also control the motion of the finish motor 14 in more than one plane in the z-axis direction.

Furthermore, the motion guidance unit 20 may accept information or instructions as a batch of program code segments or as a series of keystrokes entered directly to the motion guidance unit 20 one at a time. The information or instructions may be used to determine a path for the finish motor 14 to follow, or otherwise guide the finish motor 14 across the surface 24 of the metal sample 22. The motion guidance unit 20 may also apply a downward pressure on the finish motor 14 and in turn the finish application disk 16 against the surface 24 while the disk is rotating and the finish motor 14 is guided over the metal sample 22.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. An apparatus for forming a lightly scratched surface to a metal, the apparatus comprising:

a motor configured to provide rotational motion;

a disk rotated by the motor and including abrasive elements configured to create a plurality of scratches on the surface of the metal;

a plurality of springs configured to suspend the motor, allowing lateral motion of the motor and the disk while the motor is rotating; and a frame with a bottom wall and an opening in the bottom wall, in which the motor is positioned.

2. The apparatus of claim 1, wherein the plurality of springs includes a plurality of upper springs configured to couple the motor to the upper surface of the bottom wall.

3. The apparatus of claim 2, wherein the plurality of upper springs includes four springs that are positioned radially outward from the motor with a separation between the upper springs of approximately ninety degrees.

4. The apparatus of claim 3, wherein the plurality of springs includes a plurality of lower springs configured to couple the motor to the lower surface of the bottom wall.

5. The apparatus of claim 4, wherein the plurality of upper springs in combination with the plurality of lower springs suspend the motor within the opening.

6. The apparatus of claim 4, wherein the plurality of lower springs includes four springs that are positioned radially outward from the motor with a separation between the lower springs of approximately ninety degrees.

7. The apparatus of claim 6, wherein the orientation of the four upper springs is offset from the orientation of the four lower springs by an angle of approximately forty-five degrees.

8. The apparatus of claim 1, wherein the lateral motion of the motor and the disk allow the plurality of the scratches on the surface of the metal to have a curvature and to overlap one another.

9. The apparatus of claim 1, further including a motion guidance unit configured to retain the frame and to guide the motion of the motor across the surface of the metal.

10. An apparatus for forming a lightly scratched surface to a metal sheet, the apparatus comprising:

a frame including a bottom wall with an opening;

a motor positioned in the opening and configured to provide rotational motion;

a disk rotated by the motor and including abrasive elements configured to create a plurality of scratches on the surface of the metal sheet;

a motion guidance unit configured to retain the frame and to guide the motion of the motor across the surface of the metal sheet;

a plurality of upper springs configured to couple the motor to the upper surface of the bottom wall; and a plurality of lower springs configured to couple the motor to the lower surface of the bottom wall and in combination with the upper springs to suspend the motor within the opening of the bottom wall and to allow lateral motion of the motor and the disk while the motor is rotating.

11. The apparatus of claim 10, wherein the lateral motion of the motor and the disk allow the plurality of the scratches on the surface of the metal sheet to have a curvature and to overlap one another.

12. The apparatus of claim 10, wherein the plurality of upper springs includes four springs that are positioned radially outward from the motor with a separation between the upper springs of approximately ninety degrees.

13. The apparatus of claim 12, wherein the plurality of lower springs includes four springs that are positioned radially outward from the motor with a separation between the lower springs of approximately ninety degrees.

14. The apparatus of claim 13, wherein the orientation of the four upper springs is offset from the orientation of the four lower springs by an angle of approximately forty-five degrees.

15. A method of constructing an apparatus for forming a lightly scratched finish to a surface of a metal sheet, the method comprising the steps of:

a) forming an opening in a bottom wall of a frame;

b) positioning within the opening a motor that includes a disk with abrasive elements;

c) coupling the frame to a motion guidance unit that controls the motion of the motor across the surface; and d) coupling a plurality of springs from the motor to the bottom wall such that the motor is suspended within the opening and that lateral motion of the motor is allowed while the motor is rotating.

16. The method of claim 15, wherein step d) further includes coupling a plurality of upper springs from the motor to the upper surface of the bottom wall and coupling a plurality of lower springs from the motor to the lower surface of the bottom wall.

17. The method of claim 16, wherein the upper springs in combination with the lower springs suspend the motor within the opening.

18. The method of claim 16, wherein the plurality of upper springs includes four springs that are positioned radially outward from the motor with a separation between the upper springs of approximately ninety degrees.

19. The method of claim 18, wherein the plurality of lower springs includes four springs that are positioned radially outward from the motor with a separation between the lower springs of approximately ninety degrees.

20. The method of claim 19, wherein the orientation of the four upper springs is offset from the orientation of the four lower springs by an angle of approximately forty-five degrees.

21. The method of claim 15, wherein the lateral motion of the motor allows the abrasive elements to apply scratches to the surface of the metal sheet, such that the scratches have a curvature and overlap one another.

* * * * *